US009469017B2

(12) United States Patent
Seith et al.

(10) Patent No.: US 9,469,017 B2
(45) Date of Patent: Oct. 18, 2016

(54) ONE-PIECE POWER SOCKET FOR AN IMPACT TOOL

(71) Applicant: Ingersoll-Rand Company, Davidson, NC (US)

(72) Inventors: Warren A. Seith, Bethlehem, PA (US); Aaron M. Crescenti, Glen Gardner, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 245 days.

(21) Appl. No.: 14/169,999

(22) Filed: Jan. 31, 2014

(65) Prior Publication Data

US 2015/0217431 A1 Aug. 6, 2015

(51) Int. Cl.
*B25B 13/06* (2006.01)
*B25B 21/02* (2006.01)

(52) U.S. Cl.
CPC ..... *B25B 13/06* (2013.01); *B25B 13/065* (2013.01); *B25B 21/02* (2013.01)

(58) Field of Classification Search
CPC ..... B25B 13/06; B25B 13/065; B25B 21/00; B25B 21/02; B25B 21/026; B25B 23/0035
USPC ..... 81/121.1, 124.6
See application file for complete search history.

(56) References Cited

U.S. PATENT DOCUMENTS 1,592,183 A 7/1926 De Golyer
2,301,860 A 11/1942 Doane
2,608,444 A 8/1952 Ronfeldt
2,969,660 A 1/1961 Dale et al.
3,710,873 A 1/1973 Allen et al.
3,741,313 A 6/1973 States et al.
3,744,350 A * 7/1973 Raff ..... B25B 23/1405 81/477
3,859,821 A * 1/1975 Wallace ..... F16D 3/76 464/89
4,157,120 A 6/1979 Anderson
4,541,160 A 9/1985 Roberts
4,561,507 A 12/1985 Liou
4,671,141 A 6/1987 Hanson
4,708,209 A 11/1987 Aspinwall
5,181,148 A 1/1993 Blanchette et al.
D338,146 S * 8/1993 Gramera ..... D8/70
5,328,308 A 7/1994 Ducker, III et al.
5,535,867 A 7/1996 Coccaro et al.
5,845,718 A 12/1998 Cooper et al.
5,848,655 A 12/1998 Cooper et al.
5,992,538 A 11/1999 Marcengill et al.
6,098,726 A 8/2000 Taylor et al.
6,196,332 B1 3/2001 Albert et al.
6,202,968 B1 3/2001 Lehr
6,463,824 B1 10/2002 Prell et al.
6,863,134 B2 3/2005 Seith et al.
7,127,969 B2 * 10/2006 Hsieh ..... B25B 13/06 81/120
7,153,214 B2 12/2006 Delaney et al.
7,997,169 B1 8/2011 Hack (Continued)

FOREIGN PATENT DOCUMENTS

CN 1765589 5/2006
DE 940877 3/1956

(Continued)

*Primary Examiner* — Hadi Shakeri
(74) *Attorney, Agent, or Firm* — Barnes & Thornburg LLP

(57) ABSTRACT

A socket for an impact tool includes an input recess configured to receive an anvil of the impact tool and an output recess configured to receive a head of a fastener.

4 Claims, 11 Drawing Sheets

(56) References Cited

U.S. PATENT DOCUMENTS

| | | | | |
|---|---|---|---|---|
| 8,109,183 | B2 * | 2/2012 | Santamarina | B25B 15/001 173/211 |
| 8,220,366 | B1 | 7/2012 | Fierro et al. | |
| 2002/0071235 | A1 | 6/2002 | Gorczyca et al. | |
| 2003/0010511 | A1 | 1/2003 | Hecht | |
| 2004/0182587 | A1 | 9/2004 | May et al. | |
| 2005/0016333 | A1 | 1/2005 | Compton | |
| 2005/0135890 | A1 | 6/2005 | Bauman | |
| 2006/0006976 | A1 | 1/2006 | Bruno | |
| 2006/0175773 | A1 | 8/2006 | Tsai et al. | |
| 2006/0225540 | A1 | 10/2006 | Tsai et al. | |
| 2006/0250029 | A1 | 11/2006 | Kelly et al. | |
| 2007/0142188 | A1 | 6/2007 | Lien | |
| 2007/0289760 | A1 | 12/2007 | Sterling et al. | |
| 2008/0099217 | A1 | 5/2008 | Ball et al. | |
| 2009/0014193 | A1 | 1/2009 | Barezzani et al. | |
| 2009/0101376 | A1 | 4/2009 | Walker et al. | |
| 2010/0000749 | A1 | 1/2010 | Andel | |
| 2010/0000750 | A1 | 1/2010 | Andel | |
| 2011/0030984 | A1 | 2/2011 | Chen | |
| 2011/0036605 | A1 | 2/2011 | Leong et al. | |
| 2011/0056337 | A1 * | 3/2011 | Buchanan | B25B 13/04 81/124.5 |
| 2011/0056714 | A1 | 3/2011 | Elger et al. | |
| 2012/0234572 | A1 | 9/2012 | Kratzig et al. | |
| 2012/0255403 | A1 | 10/2012 | Ehlers et al. | |
| 2012/0255749 | A1 * | 10/2012 | Seith | B25B 13/06 173/1 |
| 2013/0154202 | A1 | 6/2013 | Low | |
| 2013/0205571 | A1 | 8/2013 | Fanourgiakis et al. | |
| 2015/0217431 | A1 | 8/2015 | Seith | |
| 2015/0217433 | A1 | 8/2015 | Seith et al. | |
| 2015/0343618 | A1 | 12/2015 | Wissling | |

FOREIGN PATENT DOCUMENTS

| | | |
|---|---|---|
| GB | 930816 | 7/1963 |
| GB | 2443399 A | 5/2008 |
| WO | 2011017066 A1 | 2/2011 |

* cited by examiner

ONE-PIECE POWER SOCKET FOR AN IMPACT TOOL

CROSS-REFERENCE TO RELATED APPLICATION

Cross-reference is made to U.S. patent application Ser. No. 14/169,945, entitled "POWER SOCKET FOR AN IMPACT TOOL," which is assigned to the same assignee as the present application, is filed on the same day as the present application, and is expressly incorporated herein by reference.

TECHNICAL FIELD

The present disclosure relates to accessories for impact tools and, more particularly, to rotary impact devices such as sockets for use with impact tools.

BACKGROUND

Impact wrenches and other impact tools may be used to apply torque to fasteners and secure those fasteners in a variety of applications and industries. Impact wrenches typically include a rotating mass or hammer that strikes an anvil to rotate an output shaft. A socket sized to engage a fastener (e.g., bolt, screw, nut, etc.) may be formed on the output shaft, but, typically, the socket is an accessory that may be attached and detached from the output shaft. Rather than applying a constant torque when the socket is attached to a fastener, an impact wrench applies torque with each strike of the hammer.

A socket typically includes a polygonal recess for receiving a correspondingly shaped head of the fastener. The engagement between the socket and the head of the fastener creates a spring effect between those components. Another spring effect is created by the engagement between the socket and the output shaft of the impact wrench. As used herein, the term "spring effect" refers to a mechanical property that reduces the efficiency of a kinetic energy transfer. The spring effects created by the interaction between the fastener, the socket, and the output shaft of the impact wrench may diminish the amount of kinetic energy transferred from the impact wrench to the fastener and therefore diminish the amount of torque delivered to the fastener.

The mechanical system formed by the fastener, the socket, and the output shaft of the impact wrench may be represented as a single-mass oscillator system. While the system is a rotary system, the system may be illustrated as a simplified linear system such as the one shown in FIG. 6. That system includes a typical socket, fastener, and impact wrench. As shown in FIG. 6, the mass moment of inertia of the output shaft of the impact wrench is designated by $m_1$, while the fastener is represented by ground. To illustrate a typical spring effect introduced by the connection between the output shaft and the socket, that connection is designated $k_1$ in FIG. 6. Similarly, the connection between the socket and the fastener is designated by $k_2$ to show the spring rate typically created by that connection. In the typical system shown in FIG. 6, the combined spring rate of $k_1$ and $k_2$ converts a portion of the kinetic energy created by the impact wrench into potential energy, thereby diminishing the kinetic energy transferred from the impact wrench to the fastener and reducing the amount of torque delivered to the fastener.

SUMMARY

According to one aspect, a socket for an impact tool includes a body extending between a first end and a second end. The body includes a first piece including an output recess configured to receive a head of a fastener, a second piece pivotally coupled to the first piece that includes an input recess configured to receive an anvil of the impact tool, a cylindrical outer surface that defines a first diameter, and a disk positioned between the first end and the second end. The disk defines a second diameter that is greater than the first diameter. The socket includes a compliant element positioned between the first piece and the second piece.

In some embodiments, the disk may be fixed to the first piece. In some embodiments, when the second piece is pivoted in a first direction relative to the first piece, the compliant element may be compressed between the first piece and the second piece, and when the second piece is pivoted in a second direction relative to the first piece opposite the first direction, the compliant element may be permitted to expand.

In some embodiments, when the second piece is pivoted in a first direction relative to the first piece, a first surface of the second piece may be moved away from a portion of the first piece. When the second piece is pivoted in a second direction relative to the first piece that is opposite the first direction, the first surface of the second piece may be advanced toward the portion of the first piece.

In some embodiments, the first piece may include a sidewall that has a first end and a second end. The first end of the sidewall may include the first surface and the second end of the sidewall having a channel defined therein. The compliant element may be positioned in the channel. Additionally, in some embodiments, the first surface of the first piece is moved into engagement with the second piece when the first piece is pivoted in the second direction.

In some embodiments, the sidewall of the first piece may be a first sidewall, the compliant element may be a first compliant element, and the first piece may include a second sidewall that extends orthogonal to the first sidewall. The second sidewall may have a first end that is positioned adjacent to the first sidewall and a second end having a second channel defined therein. A second compliant element may be positioned in the second channel defined in the second sidewall.

Additionally, in some embodiments, when the second piece is pivoted in a first direction relative to the first piece, the second piece may be moved away from a first surface of the first piece and toward a second surface of the first piece. When the second piece is pivoted in a second direction relative to the first piece opposite the first direction, the second piece may be advanced toward the first surface of the first piece and away from the second surface of the first piece.

In some embodiments, the compliant element may be positioned between the first surface of the first piece and a surface of the second piece such that the compliant element may be compressed when the second piece is pivoted in the first direction relative to the first piece. In some embodiments, the second piece may be advanced into engagement with the second surface of the first piece when the second piece is pivoted in the second direction.

In some embodiments, the compliant element may be selected from a group consisting of a helical spring, a cylindrical spring pin, and an elastomeric plug.

In some embodiments, the first piece may include the cylindrical outer surface of the body, and the disk may include at least two ribs extending outwardly from the cylindrical outer surface and a ring secured to an outer radial end of each rib.

In some embodiments, the disk may include a first surface extending outwardly from the cylindrical outer surface, a second surface positioned opposite the first surface and extending outwardly from the cylindrical outer surface, and an annular outer surface connecting the first surface to the second surface.

According to another aspect, a rotary impact device includes an input member, an output member pivotally coupled to the input member, a disk extending outwardly from an outer surface of the output member, and a compliant element positioned between the input member and a first surface of the output member. When the input member is pivoted in a first direction relative to the output member, the compliant element may be compressed between the input member and the first surface of the output member. When the input member is pivoted in a second direction opposite the first direction, the input member may be moved away from the first surface of the output member.

In some embodiments, the output member may include the outer surface. The disk may include at least two ribs extending outwardly from the outer surface, and a ring secured to an outer radial end of each rib. In some embodiments, the input member may include an input recess that is generally square-shaped, and the output member may include an output recess that is polygonal-shaped.

According to another aspect, a socket for an impact tool includes a body that extends between a first end and a second end. The body includes a first piece including an input recess configured to receive an anvil of the impact tool, and a second piece pivotally coupled to the first piece, the second piece including an output recess configured to receive a head of a fastener. The socket also includes means for optimizing the inertia of the socket. The means for optimizing the inertia of the socket is fixed in position relative to the second piece.

In some embodiments, the means for optimizing the inertia of the socket may add compliance when the first piece is pivoted relative to the second piece in a first direction. In some embodiments, the means for optimizing the inertia of the socket may provide engagement between the first piece and the second piece when the first piece is pivoted relative to the second piece in a second direction opposite the first direction According to another aspect, a socket for an impact tool includes a body extending between a first longitudinal end and a second longitudinal end. The body includes an input recess defined in the first longitudinal end that is configured to receive an anvil of the impact tool, an output recess defined in the second longitudinal end that is configured to receive a head of a fastener, a cylindrical outer surface that defines a first diameter, and a disk positioned between the first longitudinal end and the second longitudinal end of the body. The disk defines a second diameter that is greater than the first diameter. At least one of the input recess or the output recess is defined by a plurality of inner walls extending inwardly from an outer opening. Each inner wall includes a substantially planar first surface extending from a first end of the inner wall to an intersection point, and a substantially planar second surface extending from the intersection point to a second end of the inner wall. An obtuse angle is defined between the substantially planar first surface and the substantially planar second surface.

In some embodiments, the first surface may define a first length between the first end of the inner wall and the intersection point. The second surface may define a second length between the intersection point and the second end of the inner wall. The second length may be less than the first length.

In some embodiments, the first surfaces of the plurality of inner walls may define a first geometry of the outer opening, and the second surfaces of the plurality of inner walls may define a second geometry of the outer opening that is rotated relative to the first geometry. The second geometry may share a geometric center with the first geometry. In some embodiments, the first geometry may be the same as the second geometry. Additionally, in some embodiments, the first geometry may define a square. The first geometry may define another polygon.

In some embodiments, the intersection point between the first surface and the second surface of each inner wall may be a first intersection point, and each first surface may define a first imaginary line that intersects another first surface at a second intersection point. A second imaginary line may extend between each first intersection point and the geometric center of the first geometry and the second geometry. The second imaginary line may define first distance. A third imaginary line may extend between each second intersection point and the geometric center of the first geometry and the second geometry. The third imaginary line may define a second distance that is greater than the first distance.

In some embodiments, each second intersection point may be positioned at the first end of each inner wall.

In some embodiments, the plurality of inner walls may include a first inner wall and a second inner wall, and an acute angle may be defined between the substantially planar first surface of the first inner wall and the substantially planar second surface of the second inner wall. In some embodiments, the substantially planar first surface of the first inner wall may extend perpendicular to the substantially planar first surface of the second inner wall.

In some embodiments, the body may be formed as a single monolithic steel body.

According to another aspect, a rotary impact device includes an input recess configured to receive an anvil of an impact tool, an output recess configured to receive a head of a fastener, an outer surface, and a disk extending outwardly from the outer surface. At least one of the input recess or the output recess has an outer opening that is defined by a plurality of substantially planar first surfaces and a plurality of substantially planar second surfaces. The plurality of substantially planar first surfaces define a first geometry of the outer opening, and the plurality of substantially planar second surfaces define a second geometry of the outer opening. The second geometry is noncoincident with the first geometry and has a common geometric center with the first geometry.

In some embodiments, the first geometry may be the same as the second geometry. In some embodiments, each of the first geometry and the second geometry may define a square. Additionally, in some embodiments, each of the first geometry and the second geometry may define a polygon.

In some embodiments, each first surface of the plurality of substantially planar first surfaces may be connected to a second surface of the plurality of substantially planar second surfaces. An obtuse angle may be defined between each first surface and each second surface.

According to another aspect, a socket for an impact tool includes a body extending between a first end and a second end. The body includes an input recess configured to receive an anvil of the impact tool and an output recess configured to receive a head of a fastener. The socket also includes means for optimizing the inertia of the socket, and the means for optimizing the inertia of the socket is fixed in position relative to the input recess and the output recess.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the following figures, in which.

DETAILED DESCRIPTION OF THE DRAWINGS

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

As will become apparent from reading the present specification, any of the features of any of the embodiments disclosed herein may be incorporated within any of the other embodiments without departing from the scope of the present disclosure.

Referring now to FIGS. 1-18, various embodiments of rotary impact devices or sockets (e.g., sockets 10, 110, 210, 310, 410) are illustrated. When used with an impact wrench that produces the same amount of energy with each hammer strike, each socket is configured to deliver increased torque when rotated in one direction and deliver decreased torque when rotated in the opposite direction. For example, each rotary impact device may be configured to deliver lower torque to the fastener during installation (i.e., when tightening the fastener) and deliver higher torque to the fastener during removal (i.e., when loosening the fastener). In that way, each socket is configured to deliver torque to a fastener asymmetrically so that the torque is limited or reduced in one direction but not the other.

Figure 1:
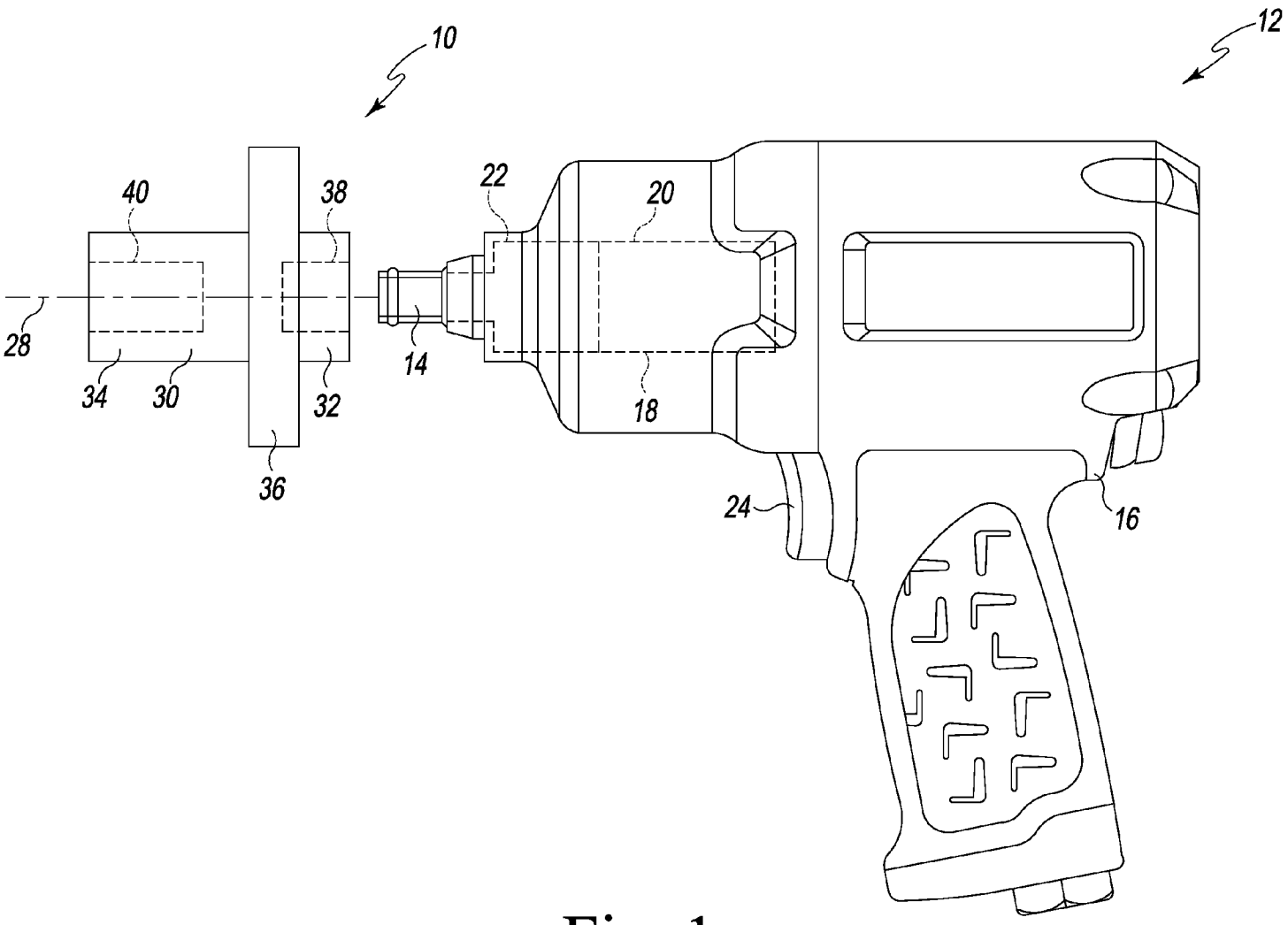
FIG. 1 is a side elevation view of a power tool and one embodiment of a rotary impact device for use with the power tool.

Referring now to FIG. 1, a rotary impact device or socket 10 may be attached to, and driven by, an impact tool 12. The impact tool 12 is illustratively embodied as an impact wrench 12 that includes an output shaft 14 sized to receive the socket 10. As described in greater detail below, the socket 10 may be selectively secured to the shaft 14. It should be appreciated that in other embodiments the socket 10 may be formed on or in the shaft 14.

The wrench 12 includes housing 16 that encases an impact mechanism 18. The impact mechanism 18 is configured to be driven by a source of compressed air (not shown), but in other embodiments other sources of power may be used. Those sources include electricity, hydraulics, etc. The impact mechanism 18 includes a mass such as, for example, a hammer 20 that is configured to spin or rotate and an anvil 22 that is attached to the output shaft 14. In the illustrative embodiment, the hammer 20 is configured to slide within the housing 16 toward the anvil 22 when rotated. A spring (not shown) or other biasing element biases the hammer 20 out of engagement with the anvil 22.

The output shaft 14 of the wrench 12 extends outwardly from the housing 16. In the illustrative embodiment, the output shaft 14 and the anvil 22 form a single monolithic component. In other embodiments, the output shaft may be formed separately from the anvil. As shown in FIG. 1, the wrench 12 also includes a trigger 24 that is moveably coupled to the housing 16.

In use, compressed air is delivered to the impact mechanism 18 when the trigger 24 is depressed. The compressed air causes the hammer 20 to rotate and strike the anvil 22. The impact between the hammer 20 and anvil 22 causes the anvil 22 (and hence the output shaft 14) to rotate, thereby transferring the kinetic energy of the hammer 20 to the output shaft 14. After the hammer 20 strikes the anvil 22, the spring urges the hammer 20 away from the anvil 22. In the illustrative embodiment, the hammer 20 strikes the anvil 22 once per revolution. In other embodiments, the hammer may be configured to strike the anvil more than once per revolution. With each strike of the hammer 20, a fixed amount of energy is delivered through the anvil 22 to the output shaft 14.

Figure 2:
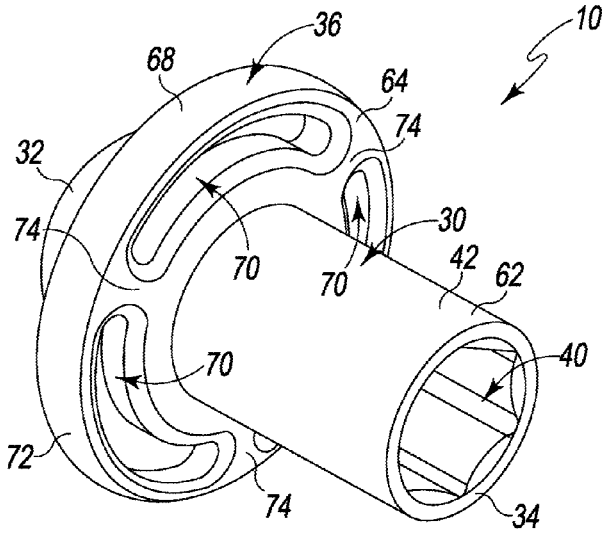
FIG. 2 is a perspective view of the rotary impact device of FIG. 1.
Figure 3:
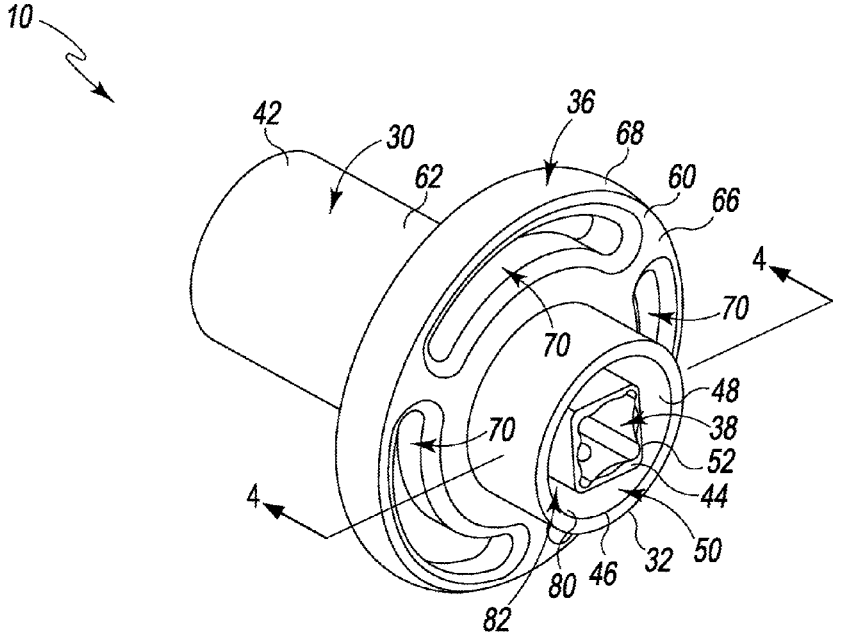
FIG. 3 is another perspective view of the rotary impact device of FIG. 1.

As shown in FIGS. 1-3, the socket 10 has a longitudinal axis 28 that defines the rotational axis of the socket 10 when it is secured to the output shaft 14. The socket 10 also includes a body 30 that extends along the axis 28 from a longitudinal end 32 to the opposite longitudinal end 34. The socket 10 also includes an inertia member 36 that is attached to the body 30 between the ends 32, 34. An input recess 38, which is sized to receive the output shaft 14 of the wrench 12, is defined at the longitudinal end 32 of the body 30. In the illustrative embodiment, the recess 38 is square-shaped (see FIG. 3) to match the square-shaped cross-section of the output shaft 14. It should be appreciated that in other embodiments the output shaft 14 may have other cross-sectional shapes, such as, for example, a hexagonal or octagonal shape. In such embodiments, the recess 38 may be shaped to match the configuration of the output shaft 14.

The socket 10 includes an output recess 40 that is defined at the other longitudinal end 34 of the body 30. The output recess 40 is sized to receive a head of a fastener. In the illustrative embodiment, the recess 40 is hexagonal (see FIG. 2) to match a hexagonal-shaped fastener head. The fastener may be a bolt, screw, lug nut, etc. It should be appreciated that in other embodiments the output recess 40 may be configured to receive fasteners having other types of heads, such as, for example, square, octagonal, Phillips, flat, and so forth.

The body 30 of the socket 10 includes an outer component 42 and an inner component 44 that is pivotally coupled to the outer component 42. In the illustrative embodiment, the output recess 40 is defined in the outer component 42, as shown in FIG. 2, and the input recess 38 is defined in the inner component 44. In other embodiments, the location of the recesses may be reversed, with the output recess defined in the inner component and the input recess defined in the outer component. Each of the components 42, 44 is illustratively formed from a metallic material such as, for example, steel.

As shown in FIG. 3, an opening 46 is defined in the outer component 42 at the longitudinal end 34. An inner wall 48 extends inwardly from the opening 46 to define an aperture 50 in the component 42. The inner component 44 is positioned in the aperture 50. The inner component 44 extends inwardly from an end 52 positioned adjacent to the opening 46 to an opposite end 54 (see FIGS. 4-5). In other embodiments, the inner component may extend outwardly from the outer component.

The inner component 44 of the socket 10 may be attached to the outer component 42 using a variety of methods. For example, the inner component 44 may include a flange that is retained in a cylindrical slot or groove defined in the inner wall 48 of the outer component 42 such that the flange may move along the slot, thereby permitting the inner component 44 to rotate relative to the outer component 42. In other embodiments, the socket 10 may include a roller bearing that has an outer diameter press-fit into the aperture 50 and inner diameter that is press-fit onto the inner component 44. In still other embodiments, a metallic bushing formed from, for example, bronze or a similar material, may be used to join the two components.

In the illustrative embodiment, the inertia member 36 of the socket 10 includes a disk 60 that is fixed to the outer component 42. In that way, the disk 60 is prevented from rotating relative to the outer component 42 (and hence the output recess) and permitted to rotate relative to the inner component 44 (and hence the input recess). In other embodiments, the inertia member 36 may be fixed to the inner component (and hence the input recess) rather than the outer component 42 (and hence the output recess). As shown in FIGS. 2-3, the outer component 42 has a cylindrical outer surface 62 that extends from the end 32 to the end 34, and the disk 60 of the member 36 includes a pair of side surfaces 64, 66 that extend outwardly from the surface 62. It should be appreciated that in other embodiments the disk and the outer surface of the component 42 may take other geometric forms. As shown in FIG. 1, the disk 60 has a diameter that is greater than the diameter of the component 42. By adding mass to the socket 10 at a distance from the rotational axis that is greater than the outer surface of the socket body 30, the disk 60 is configured to act as a stationary flywheel for the socket 10, as described in greater detail below.

The outer component 42 and the disk 60 form a single monolithic component. As a result, the disk 60, like the component 42, is formed from steel. It should be appreciated that in other embodiments the inertia member 36 and the component 42 may be formed as separate components that are later assembled together. In such embodiments, the member 36 and the component 42 may be formed from the same or different materials.

The disk 60 also includes an annular surface 68 that extends between the side surfaces 64, 66. A set of bores or through-slots 70 extends through the side surfaces 64, 66. In the illustrative embodiment, the inertia member 36 includes three through-slots 70 that are spaced apart equally around the circumference of the disk 60. The location and number of slots 70 divide the disk 60 into an outer ring 72 that is connected to the outer component 42 via three ribs 74. As shown in FIG. 2, the ribs 74 are spaced apart equally around the circumference of the outer surface 62 of the component 42. It should be appreciated that in other embodiments the disk 60 may include additional slots 70. In still other embodiments, the slots 70 may be omitted.

Figure 4:
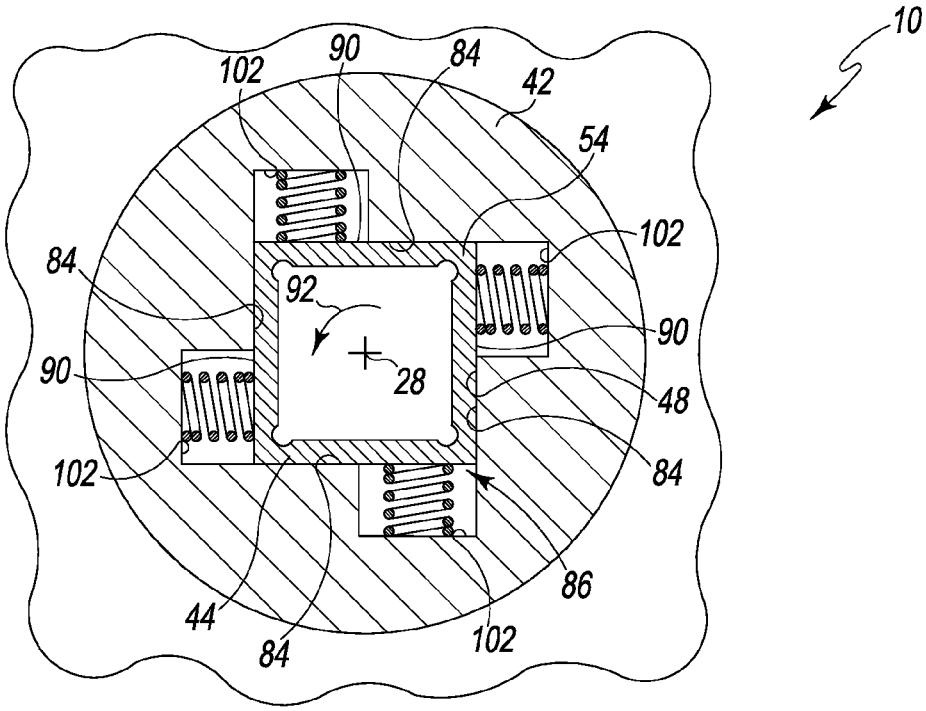
FIG. 4 is a cross-sectional elevation view of the rotary impact device taken along the line 4-4 in FIG. 3 showing a component of the rotary impact device in a first position.
Figure 5:
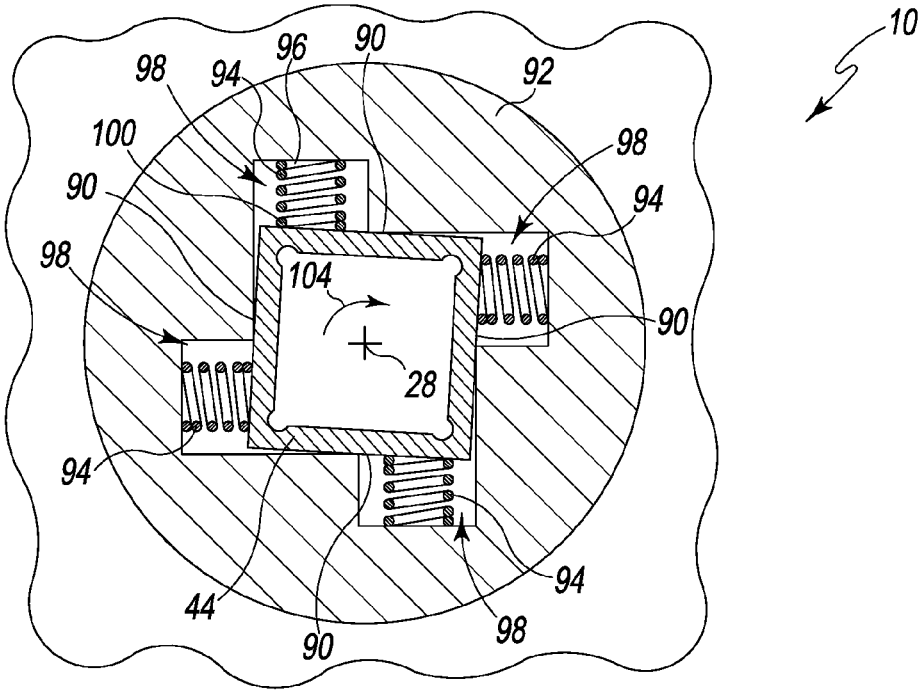
FIG. 5 is a view similar to FIG. 4 showing the component of the rotary impact device in a second position.
Figure 6:
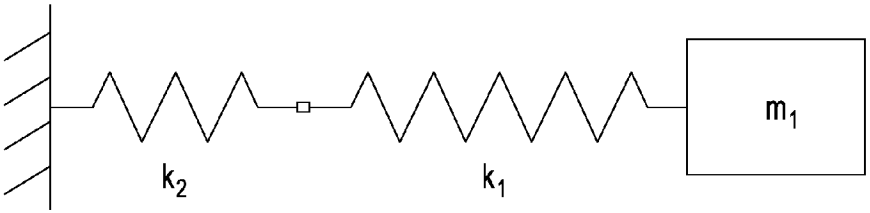
FIG. 6 is a simplified block diagram illustrating a power tool connected to a standard socket and a fastener.

As shown in FIG. 2, the inner wall 48 of the outer component 42 includes a cylindrical surface 80 that defines a cylindrical passage 82 of the aperture 50. As shown in FIGS. 4-5, the inner wall 48 also includes a plurality of substantially planar surfaces 84 that define a polygonal-shaped passage 86 of the aperture 50. As described above, the inner component 44 includes an end 54, and the end 54 is received in the polygonal-shaped passage 86 of the aperture 50. In the illustrative embodiment, the end 54 of the component 44 and the passage 86 are square-shaped. It should be appreciated that in other embodiments the end 54 of the component 44 may have another shape, such as, for example, a hexagonal or octagonal shape. In such embodiments, the passage 86 of the aperture 50 may be shaped to match the configuration of the component 44.

The inner component 44 includes a plurality of outer walls 90 that define the square-shape of the end 54. As described above, the inner component 44 is configured to pivot relative to the outer component 42. When the inner component 44 is pivoted in counter-clockwise as indicated in FIG. 4 by arrow 92, the outer walls 90 of the inner component 44 engage the planar surfaces 84 of the outer component 42. In that way, the socket 10 provides a solid contact interface between the components 42, 44 when the inner component 44 is pivoted counter-clockwise.

As shown in FIGS. 4-5, the socket 10 also includes a number of compliant elements 94 that are positioned between the components 42, 44. In the illustrative embodiment, the socket 10 includes four elements 94, and each complaint element 94 is embodied as a helical spring. Each spring 94 includes an outer end 96 that is positioned in a channel 98 defined in each surface 84 of the component 44 and an inner end 100 that is engaged with a section 102 of each outer wall 90. When the inner component 44 is pivoted clockwise as indicated in FIG. 5 by arrow 104, the outer walls 90 of the inner component 44 compress the springs 94, thereby permitting limited movement between the components 42, 44 and introducing a spring effect between the input and output of the socket 10, as described in greater detail below.

In use, the socket 10 is secured to the wrench 12 by positioning the output shaft 14 in the input recess 38 of the socket 10. The socket 10 may be then attached to a fastener by positioning the fastener head in the output recess 40. To loosen or remove a fastener, the socket 10 (and hence the fastener) is rotated counter-clockwise. To do so, a user may depress the trigger 24 of the wrench 12 to deliver compressed air to the impact mechanism 18, which causes the hammer 20 to rotate and strike the anvil 22. The impact between the hammer 20 and anvil 22 causes the anvil 22 (and hence the output shaft 14, socket 10, and fastener) to rotate counter-clockwise, thereby transferring the kinetic energy of the hammer 20 to the output shaft 14. As described above, a fixed amount of energy is delivered through the anvil 22 to the output shaft 14 with each strike of the hammer 20.

The kinetic energy is then transferred through the socket 10 to the fastener. As described above, the engagement or connection between the output shaft 14 and the socket 10 introduces a spring effect into the system, while the engagement or connection between the socket 10 and the fastener introduces another spring effect into the system. When the socket 10 is rotated counter-clockwise, the outer walls 90 of the inner component 44 engage the planar surfaces 84 of the outer component 42 such that a solid contact interface exists between the components 42, 44, and the springs 94 remain uncompressed.

Figure 7:
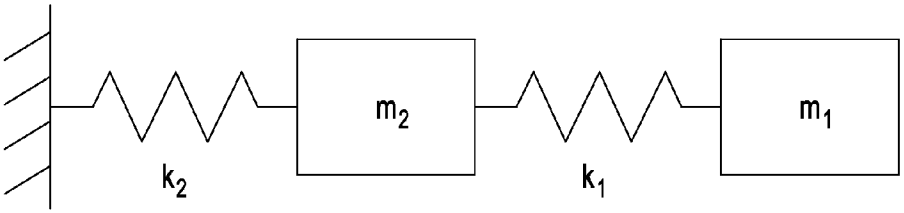
FIG. 7 is a simplified block diagram illustrating the power tool and the rotary impact device of FIG. 1 connected to a fastener representing the rotary impact device when rotating in a first direction.

The engagement between the components 42, 44 permits the mechanical system formed by the fastener, the socket 10, and the output shaft 14 of the impact wrench 12 to be represented as a simplified linear dual-mass oscillator system 106, as shown in FIG. 7. In the dual-mass system 106, the mass moment of inertia of the output shaft 14 of the impact wrench 12 is designated by $m_1$, and the mass moment of inertia of the disk 60 of the inertia member 36 is designated by $m_2$. As shown in FIG. 7, the fastener is represented by the ground, and the connection between the output shaft 14 and the socket 10 is designated $k_1$. Similarly, the connection between the socket 10 and the fastener is designated by $k_2$ to show the spring rate created by that connection.

As described above, the disk 60 is sized to act as a stationary flywheel, and the kinetic energy from the output shaft 14 is transferred through the connection ($k_1$) between the shaft 14 and the socket 10 to the inner component 44. The engagement between the outer walls 90 of the inner component 44 and the planar surfaces 84 of the outer component 42 causes the outer component 42 (and hence the disk 60) to accelerate, thereby transferring and storing the kinetic energy in the disk 60. Because the outer component 42 (and hence the disk 60) is engaged with the fastener, the disk 60 is forced to decelerate rapidly such that the kinetic energy stored in the disk 60 is transferred rapidly to the fastener to provide increased torque.

To tighten or install a fastener, the user may operate a switch to reverse the direction of rotation of the impact wrench 12 such that the socket 10 (and hence the fastener) is rotated clockwise. To do so, a user may depress the trigger 24 of the wrench 12 to deliver compressed air to the impact mechanism 18, which causes the hammer 20 to rotate and strike the anvil 22. The impact between the hammer 20 and anvil 22 causes the anvil 22 (and hence the output shaft 14, socket 10, and fastener) to rotate clockwise, thereby transferring the kinetic energy of the hammer 20 to the output shaft 14. As described above, a fixed amount of energy is delivered through the anvil 22 to the output shaft 14 with each strike of the hammer 20.

Figure 8:
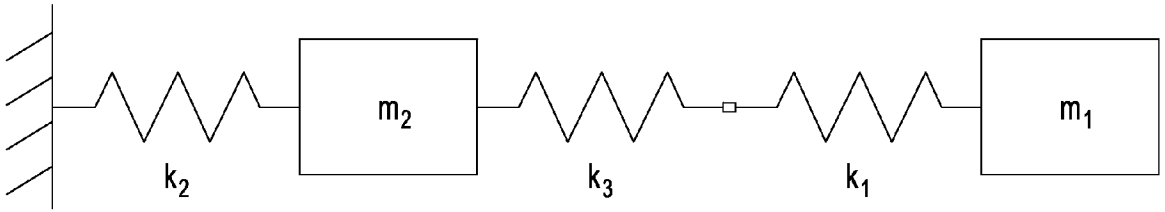
FIG. 8 is a simplified block diagram similar to FIG. 7 representing the rotary impact device when rotating in a second direction opposite the first direction.

The kinetic energy is then transferred through the socket 10 to the fastener. When the socket 10 is rotated clockwise, the outer walls 90 of the inner component 44 compress the springs 94, thereby permitting limited movement between the components 42, 44 and introducing a spring effect between the input and output of the socket 10. The mechanical system formed by the fastener, the socket 10, and the output shaft 14 of the impact wrench 12 when the socket 10 is rotated clockwise may be represented as a simplified linear dual-mass oscillator system 108, as shown in FIG. 8. In the dual-mass system 108, the mass moment of inertia of the output shaft 14 of the impact wrench 12 is designated by $m_1$, and the mass moment of inertia of the disk 60 of the inertia member 36 is designated by $m_2$. As shown in FIG. 8, the fastener is again represented by the ground, and the connection between the output shaft 14 and the socket 10 is designated $k_1$. Similarly, the connection between the socket 10 and the fastener is designated by $k_2$ to show the spring rate created by that connection. The additional spring effect created by the engagement between the inner component 44 and the springs 94 is designated by $k_3$.

The kinetic energy from the output shaft 14 is transferred through the connection ($k_1$) between the shaft 14 and the socket 10 to the inner component 44, and the energy is then transferred via the connection ($k_3$) and stored in the disk 60. The combined spring rate of $k_1$ and $k_3$ converts a portion of the kinetic energy into potential energy, thereby diminishing the kinetic energy transferred to the disk 60 when the socket 10 is rotated clockwise. As such, less energy is transferred to the fastener when the disk 60 decelerates such that less torque is provided to the fastener when the fastener is tightened than when it is loosened. In that way, the socket 10 is configured to deliver torque to a fastener asymmetrically so the torque is limited or reduced in one direction relative to the other direction.

Figure 9:
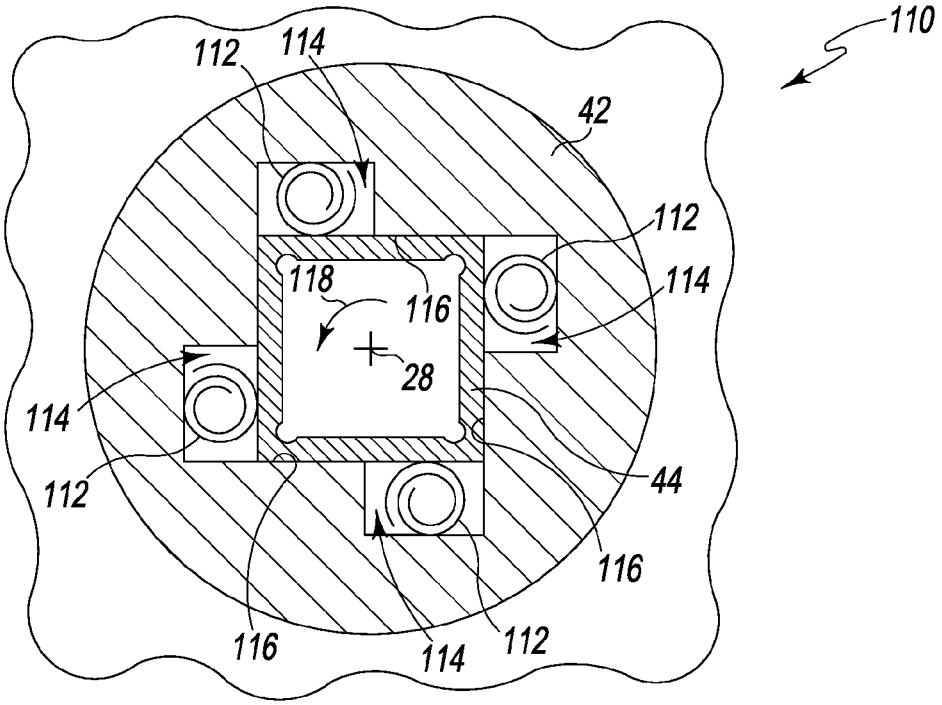
FIG. 9 is a cross-sectional elevation view similar to FIG. 4 showing another embodiment of a rotary impact device including a component of the rotary impact device in a first position.
Figure 10:
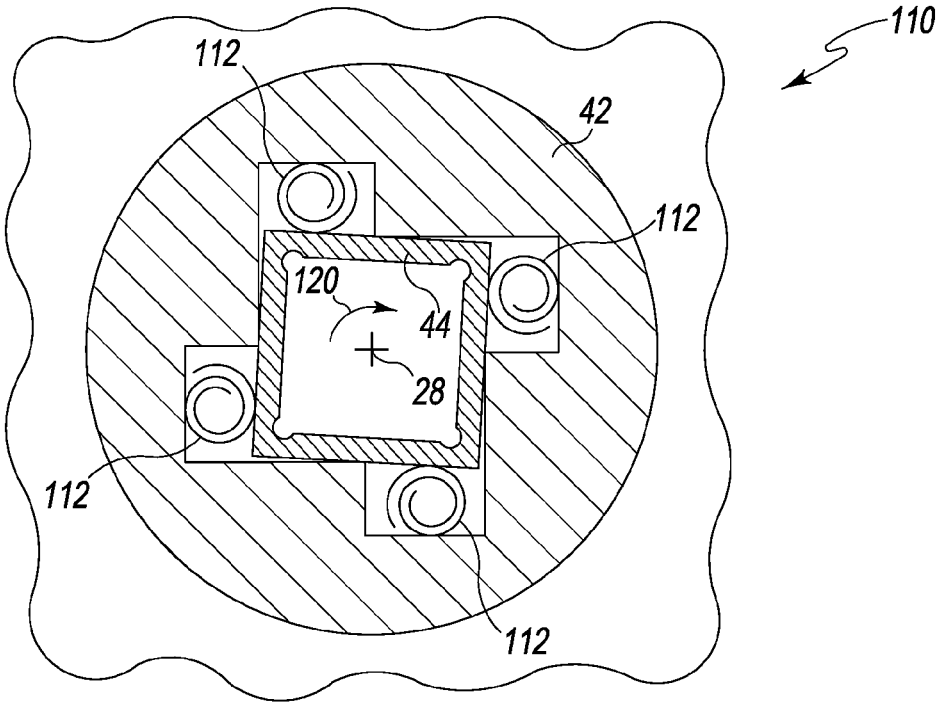
FIG. 10 is a view similar to FIG. 9 showing the component of the rotary impact device in a second position.

Referring now to FIGS. 9-10, another embodiment of a rotary impact device (hereinafter socket 110) is shown. Many features of the embodiment of FIGS. 9-10 are the same as the features of the embodiment of FIGS. 1-8. The same reference numbers used in FIGS. 1-8 will be used to identify those features that are the same in FIGS. 9-10. As shown in FIG. 9, the socket 110 includes an inner component 44 and an outer component 42. The inner component 44 includes an end 54 that is positioned in a passage 86 of the outer component. The socket 110 also includes a number of compliant elements 94 that are positioned between the components 42, 44. In the embodiment of FIG. 9, each compliant element is embodied as a cylindrical spring pins 112 rather than the helical springs included in the embodiment of FIGS. 1-8. Each cylindrical spring pin 112 is positioned in a channel 114 defined in a surface 116 of the outer component 42.

Figure 11:
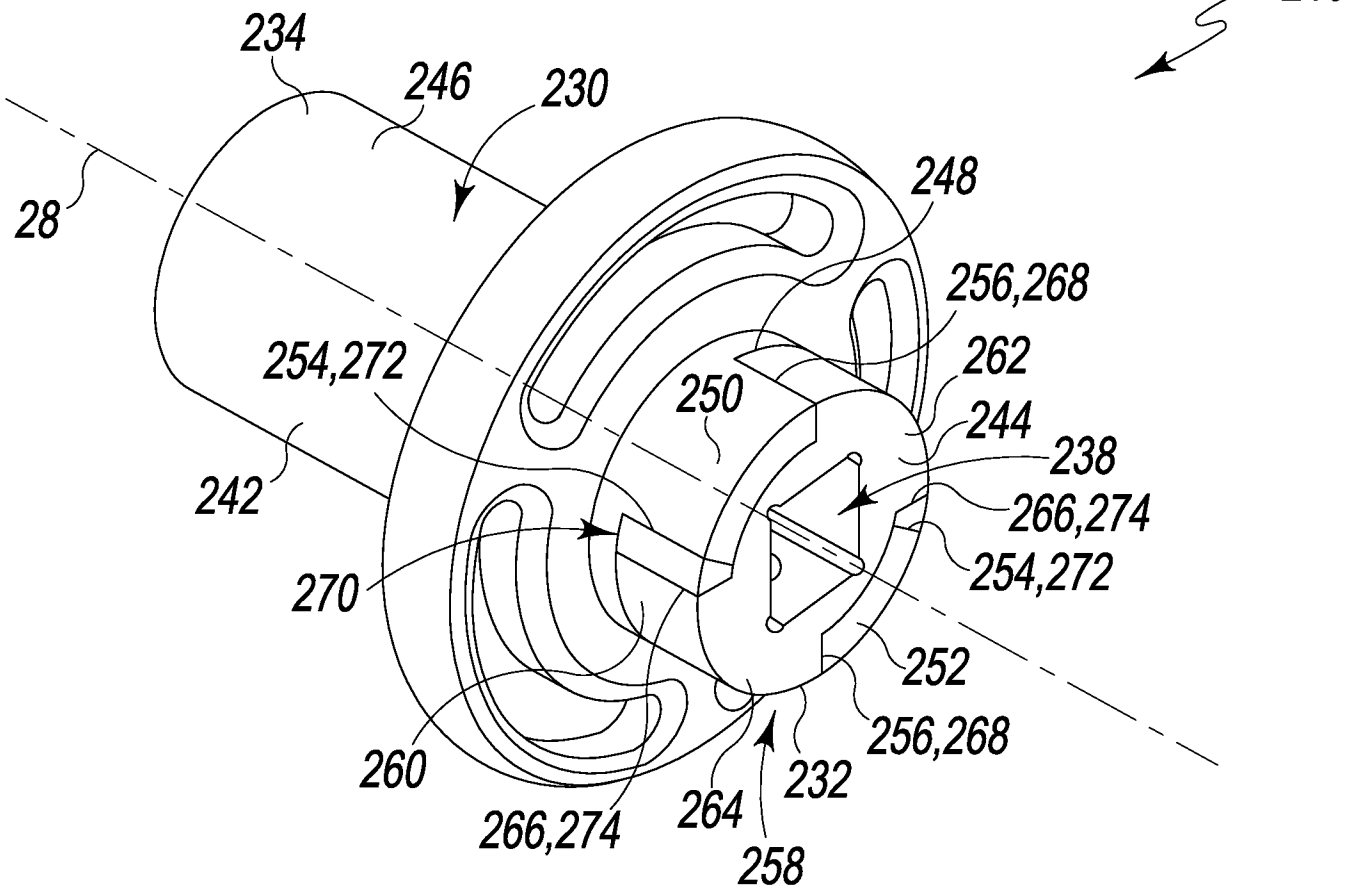
FIG. 11 is a perspective view of another embodiment of a rotary impact device.
Figure 12:
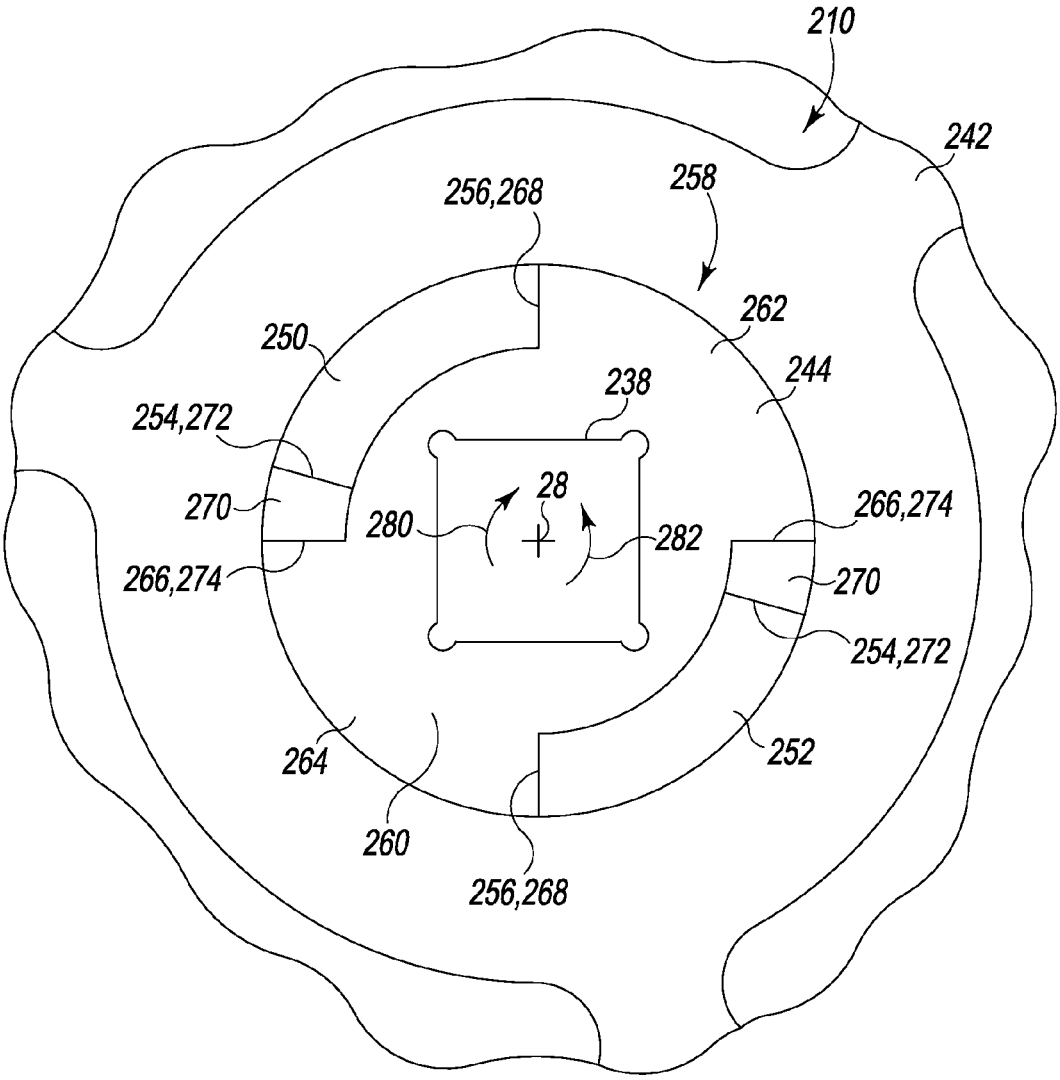
FIG. 12 is an elevation view of the rotary impact device of FIG. 11.

When the inner component 44 of the socket 110 is pivoted in a counterclockwise direction, as indicated in FIG. 9 by arrow 118, the inner component 44 engages the surfaces 116 of the outer component 42 such that a solid contact interface exists between the components. Similarly, when the inner component 44 of the socket 110 is pivoted in a clockwise direction, as indicated in FIG. 10 by arrow 120, the inner component 44 compresses the springs 94, thereby permitting limited movement between components 42, 44 and introducing a spring effect between the input and output of the socket 110. Similar to the embodiment of FIGS. 1-8, Referring now to FIGS. 11-12, another embodiment of a rotary impact device (hereinafter socket 210) is shown. Many features of the embodiment of FIGS. 11-12 are the same as the features of the embodiment of FIGS. 1-8. The same reference numbers used in FIGS. 1-8 will be used to identify those features that are the same in FIGS. 11-12. As shown in FIG. 11, the socket 210 has a longitudinal axis 28 that defines the rotational axis of the socket 210 when it is secured to the output shaft 14. The socket 210 also includes a body 230 that extends along the axis 28 from a longitudinal end 232 to the opposite longitudinal end 234. The socket 210 also includes an inertia member 36 that is attached to the body 230 between the ends 232, 234.

An input recess 38, which is sized to receive the output shaft 14 of the wrench 12, is defined at the longitudinal end 232 of the body 230. In the illustrative embodiment, the recess 238 is square-shaped to match the square-shaped cross-section of the output shaft 14. The socket 210 includes an output recess (not shown) that is defined at the other longitudinal end 34 of the body 30. The output recess of the socket 210, like the output recess 40 of FIGS. 1-8, is sized to receive a head of a fastener.

The body 230 of the socket 210 includes a main component 242 and an input component 244 that is pivotally coupled to the main component 242. In the illustrative embodiment, the output recess is defined in the main component 242, and the input recess 238 is defined in the input component 244. In other embodiments, the location of the recesses may be reversed, with the output recess defined in the inner component and the input recess defined in the outer component. Each of the components 242, 244 is formed from a metallic material such as, for example, steel.

As shown in FIG. 1, the main component 242 includes a cylindrical body 246 that extends from the end 234 of the socket 210 to an intermediate end 248 positioned between the ends 232, 234. The component 242 also includes a pair of flanges 250, 252 that extend from the intermediate end 248 to the longitudinal end 232 of the socket 210. The flange 250 is positioned on one side of the socket 210, while the other flange 252 is positioned on the opposite side, with the axis 28 positioned between the flanges 250, 252.

In the illustrative embodiment, each of the flanges 250, 252 defines an arc that extends from a substantially planar end surface 254 to another substantially planar end surface 256. Each of the flanges 250, 252 extends less than the circumference of the cylindrical body 246. It should be appreciated that in other embodiments the flanges 250, 252 may be shorter or longer than the illustrative embodiment. Additionally, in other embodiments, the socket may be additional flanges or only a single flange.

As shown in FIG. 11, a slot 258 is defined between the flanges 250, 252. The slot 258 is connected to an aperture (not shown) extending into the cylindrical body 246 of the component 242. Like the aperture 50 of the socket 10, the aperture of the body 246 receives an end of the input component 244. The component 244 may be attached to the component 242 using a variety of methods. For example, the component 244 may include a flange that is retained in a cylindrical slot or groove defined in the component 242 such that the flange may move along the slot, thereby permitting the component 244 to rotate relative to the component 242.

The input component 244 of the socket 210 includes a plug 260 that is received in the slot 258 defined between the flanges 250, 252. The plug 260 includes a pair of ears 262, 264 that are positioned between the surfaces 254, 256 of the flanges 250, 252. As shown in FIGS. 11-12, the ear 262 is positioned on one side of the socket 210, while the other ear 264 is positioned on the opposite side, with the axis 28 positioned between the ears 262, 264. Each of the ears 262, 264 extends from a substantially planar end wall 266 to another substantially planar end wall 268.

As shown in FIGS. 11-12, the socket 210 also includes a number of compliant elements 270 that are positioned between the components 242, 244. In the illustrative embodiment, the socket 210 includes two elements 270, and each complaint element 270 is embodied as a polymeric wedge 270. The wedge 270 may be formed from a compressible polymeric material such as, for example, urethane-based material. In the illustrative embodiment, each wedge may be attached to one of the flanges 250, 252 via an adhesive or other fastener. Each wedge 270 has a side surface 272 that faces the end surface 254 of one of the flanges 250, 252, and another side surface 274 that faces the end wall 266 of one of the ears 262, 264. In the illustrative embodiment, the opposite end surface 256 of each flange 250, 252 faces the opposite end wall 268 of each ear 262, 264.

As a result, a spring effect is introduced when the component 244 is pivoted clockwise such as when a fastener is tightened, and no spring effect is introduced when the component 244 is pivoted counterclockwise such as when the fastener is loosened. Clockwise rotation is indicated in FIG. 12 by arrow 280, while counter-clockwise rotation is indicated by arrow 282. When the component 244 is pivoted clockwise, the end wall 266 of the ear 262 of the component 244 is pressed into the side surface 274 of one wedge 270, while the end wall 266 of the other ear 264 is pressed into the side surface 274 of the other wedge 270. Because each wedge 270 is compressible, the wedges 270 permit limited movement between the components 242, 244 such that a spring effect is introduced between the input and output of the socket 10 when the component 244 is rotated clockwise.

When the component 244 is pivoted counterclockwise as indicated by arrow 282, the end wall 268 of the ear 262 is pressed into the end surface 256 of the flange 250, in a direction away from the wedge 270. The end wall 268 of the other ear 264 is pressed into the end surface 256 of the flange 252, also in a direction way from the other wedge 270. In that way, the socket 210 provides a solid contact interface between the components 42, 44 when the inner component 44 is pivoted counter-clockwise.

As described above, the socket 210 also includes an inertia member 36. As shown in FIGS. 11-12, the inertia member 36 of the socket 210 includes a disk 60 that is fixed to the component 242. In that way, the disk 60 is prevented from rotating relative to the component 242 (and hence the output recess) and permitted to rotate relative to the component 244 (and hence the input recess). The component 242 and the disk 60 are illustratively formed as a single monolithic component. As a result, the disk 60, like the component 242, is formed from steel. It should be appreciated that in other embodiments the inertia member 36 and the component 242 may be formed as separate components that are later assembled together. In such embodiments, the member 36 and the component 242 may be formed from the same or different materials.

In use, the socket 210 is secured to the wrench 12 by positioning the output shaft 14 of the wrench 12 in the input recess 238 of the socket 210. The socket 210 may be then attached to a fastener by positioning the fastener head in the output recess. To loosen a fastener, the socket 210 (and hence the fastener) is rotated counter-clockwise in the manner described above. When the hammer 20 of the wrench 12 strikes the anvil 22, the anvil 22 (and hence the output shaft 14, socket 10, and fastener) is rotated counter-clockwise, thereby transferring the kinetic energy of the hammer 20 to the output shaft 14. As described above, the engagement or connection between the output shaft 14 and the socket 210 introduces a spring effect into the system, while the engagement or connection between the socket 210 and the fastener introduces another spring effect into the system.

When the socket 210 is rotated counter-clockwise, the end walls 268 of the component 244 engage the surfaces 256 of the component 42 such that a solid contact interface exists between the components 242, 244 and the wedges 270 are permitted to expand. Because the disk 60 is sized to act as a stationary flywheel, the engagement between the components 242, 244 causes the component 242 (and hence the disk 60) to accelerate, thereby transferring and storing the kinetic energy in the disk 60. With the component 242 (and hence the disk 60) engaged with the fastener, the disk 60 is forced to decelerate rapidly such that the kinetic energy stored in the disk 60 is transferred rapidly to the fastener to provide increased torque during the loosening operation.

To tighten a fastener, the socket 210 (and hence the fastener) may be rotated clockwise in the manner described above. When the hammer 20 of the wrench 12 strikes the anvil 22, the anvil 22 (and hence the output shaft 14, socket 10, and fastener) may be rotated clockwise, thereby transferring the kinetic energy of the hammer 20 to the output shaft 14. When the socket 210 is rotated clockwise with the shaft 14, the end walls 266 of the component 244 compress the wedges 270, thereby permitting limited movement between the components 242, 244 and introducing a spring effect between the input and output of the socket 10. That spring effect converts an additional portion of the kinetic energy into potential energy, thereby diminishing the kinetic energy transferred to the disk 60 when the socket 210 is rotated clockwise. As such, less energy is transferred to the fastener when the disk 60 decelerates such that less torque is provided to the fastener when tightening the fastener than when loosening the fastener.

Figure 13:
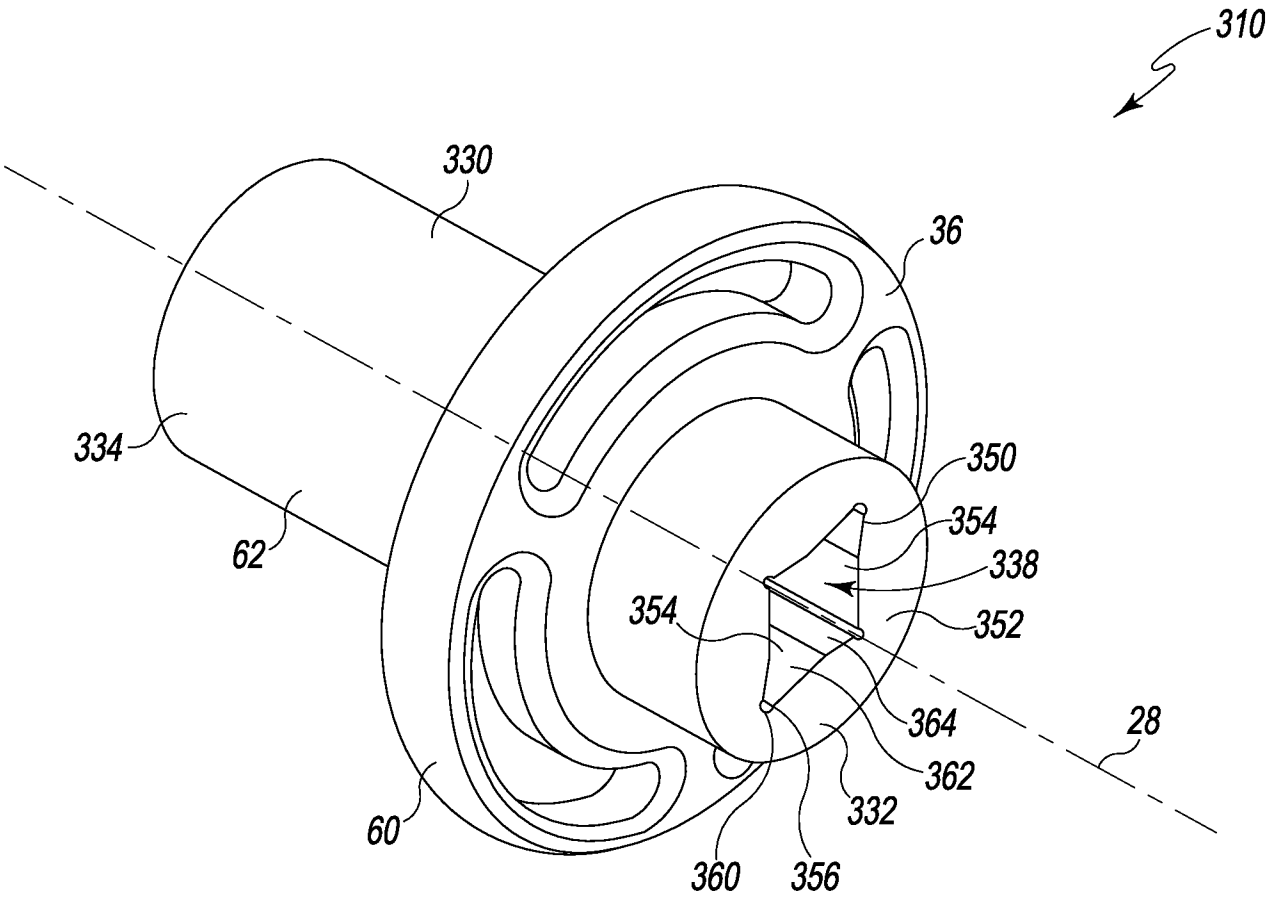
FIG. 13 is a perspective view of another embodiment of a rotary impact device.
Figure 14:
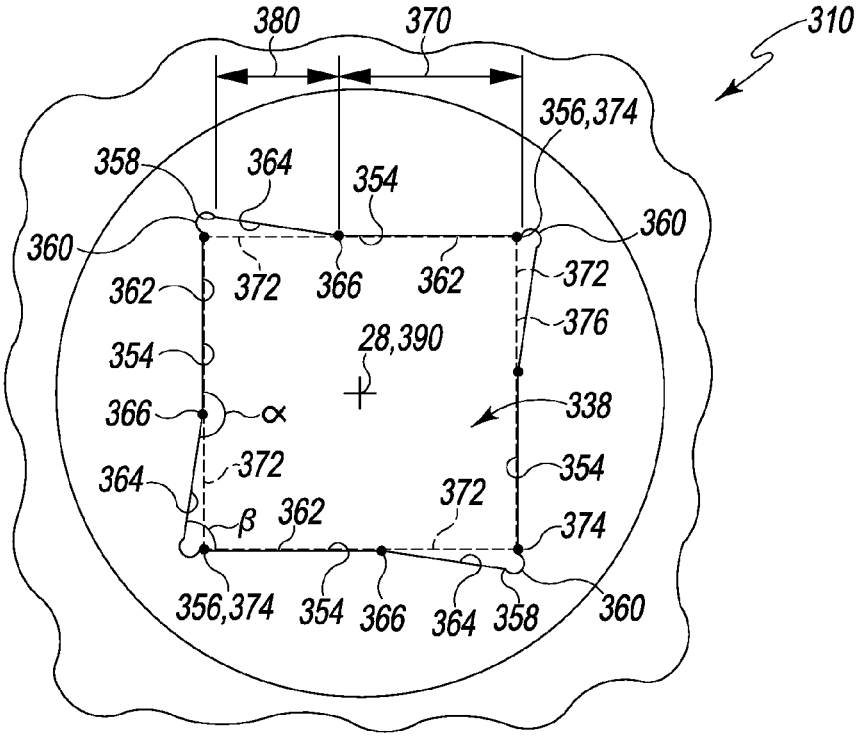
FIG. 14 is an elevation view of the rotary impact device of FIG. 13 showing the input recess.
Figure 15:
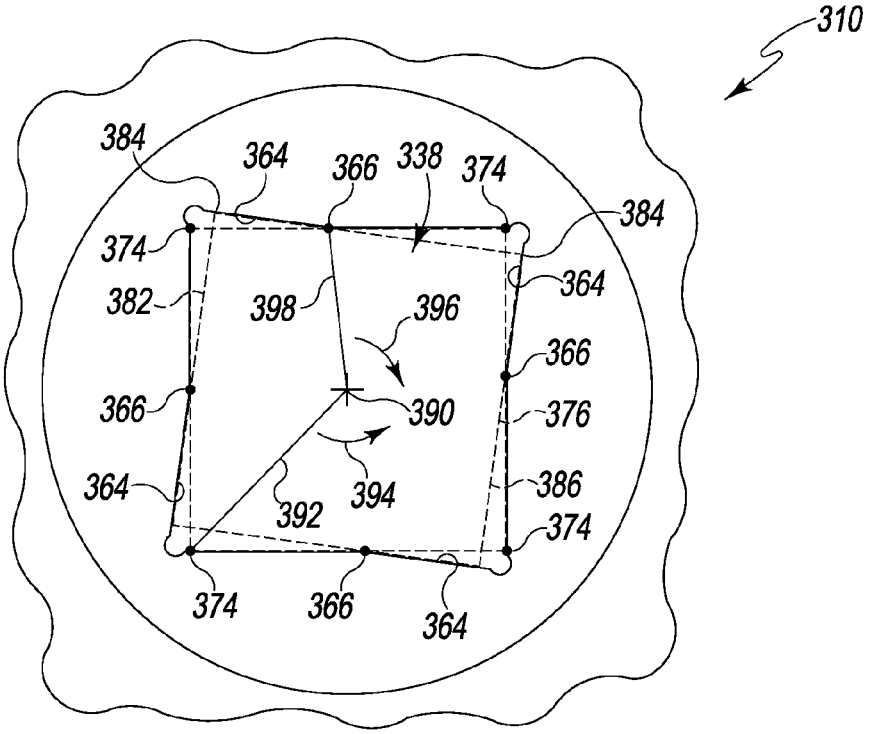
FIG. 15 is an elevation view similar to FIG. 14 showing the geometries defined by the input recess.

Referring now to FIGS. 13-15, another embodiment of a rotary impact device (hereinafter socket 310) is shown. Many features of the embodiment of FIGS. 13-15 are the same as the features of the embodiment of FIGS. 1-8. The same reference numbers used in FIGS. 1-8 will be used to identify those features that are the same in FIGS. 13-15. As shown in FIG. 13, the socket 310 has a longitudinal axis 28 that also defines the rotational axis of the socket 310 when it is secured to the output shaft 14. The socket 310 also includes a body 330 that extends along the axis 28 from a longitudinal end 332 to the opposite longitudinal end 334. The socket 310 also includes an inertia member 36 that is attached to the body 330 between the ends 332, 334.

In the embodiment of FIGS. 13-15, the body 330 and the inertia member 36 form a single monolithic component. The body 330 and the inertia member 36 are illustratively formed from a metallic material such as, for example, steel. It should be appreciated that in other embodiments the inertia member 36 and the body 330 may be formed as separate components that are later assembled together. In such embodiments, the member 36 and the body 330 may be formed from the same or different materials.

As shown in FIG. 13, the body 330 of the socket 310 has a cylindrical outer surface 62 that extends from the end 332 to the end 334. The inertia member 36 includes a disk 60 that extends outwardly from the outer surface 62 of the body 330, and the disk 60 acts as a stationary flywheel for the socket 310. The socket 310 also includes an output recess (not shown) that is defined at the longitudinal end 334 of the body 330. The output recess of the socket 310, like the output recess 40 of FIGS. 1-8, is sized to receive a head of a fastener.

An input recess 338, which is sized to receive the output shaft 14 of the wrench 12, is defined at the longitudinal end 332 of the body 330. As shown in FIG. 13, the input recess 338 includes an opening 350 defined in an end surface 352 of the body 330. A plurality of inner walls 354 extend inwardly from the opening 350 to define the input recess 338. As described in greater detail below, the input recess 338 is sized to receive the output shaft 14 of the wrench 12.

Referring now to FIG. 14, each inner wall 354 defining the input recess 338 extends from an end 356 to another end 358. In the illustrative embodiment, a bevel 360 is formed at each of the ends 356, 358 of each inner wall 354 to guide the shaft 14 into the recess 338. It should be appreciated that in other embodiments the bevels may be omitted.

Each inner wall 354 also includes a substantially planar surface 362 that extends from the end 358 toward the end 356. Another substantially planar surface 364 that extends from the end 358 toward the other surface 362, and the surfaces 362, 364 meet at an intersection point 366. As shown in FIG. 14, the surface 364 of each inner wall 354 is angled relative to its corresponding surface 362, and an angle $\alpha$ is defined between the surfaces 362, 364. In the illustrative embodiment, the angle $\alpha$ is an obtuse angle such that each surface 364 extends radially outward from the intersection point 366 to the end 358. Additionally, an angle $\beta$ is defined between the surfaces 362, 364 of adjacent inner walls 354. In the illustrative embodiment, the angle $\beta$ is an acute angle. It should be appreciated that in other embodiments the angle $\alpha$ may be an acute angle. In other embodiments, the angle $\beta$ may be an obtuse angle.

As shown in FIG. 14, the surface 362 of each inner wall 354 defines a distance 370 between the end 356 and the intersection point 366. Each surface 362 defines an imaginary line 372 that intersects the surface 362 of an adjacent inner wall 354 at an intersection point 374. In the illustrative embodiment, the imaginary line 372 is positioned orthogonal to the surface 362 of the adjacent inner wall 354. In that way, the surfaces 362 of adjacent inner walls 354 extend perpendicular to each other, and the surfaces 362 cooperate to define a geometry 376 of the recess 338 that is square-shaped. As shown in FIG. 14, the intersection points 374 are positioned at each corner of the square-shaped geometry 376. The geometry 376 illustratively matches the configuration of the shaft 14 of the wrench 12. It should be appreciated that in other embodiments the surfaces 362 may define a different geometric shape such as, for example, a hexagonal, octagonal, or other polygonal shape to match a polygonal shape of a shaft 14.

The other surface 364 of each inner wall 354 defines a distance 380 between the end 358 and the intersection point 366. In the illustrative embodiment, the distance 380 defined by the surface 364 is less than the distance 370 defined by the surface 362, and, as shown in FIG. 14, each surface 364 is shorter than each surface 362. As shown in FIG. 15, each surface 364 defines an imaginary line 382 that intersects the surface 364 of an adjacent inner wall 354 at an intersection point 384. In the illustrative embodiment, the imaginary line 382 is positioned orthogonal to the surface 364 of the adjacent inner wall 354, and the surfaces 364 cooperate to define a geometry 386 of the recess 338 that is also square-shaped.

As shown in FIG. 15, the geometry 386 is rotated relative to the geometry 376, the geometry 386 matches the geometry 376. In the illustrative embodiment, the geometries 376, 386 share a common geometric center 390, which is also coincident with the longitudinal axis 28 of the socket 310. It should be appreciated that in other embodiments the geometries 376, 386 may be offset from one another. In still other embodiments, the geometries 376, 386 may not match.

In use, the outermost point of drive contact between the shaft 14 and the socket 310 changes based on the direction of rotation of the shaft 14. As a result, the amount of torque delivered to the socket 310 when loosening the fastener (i.e., when the shaft 14 is rotated counterclockwise) is different from the amount of torque delivered when tightening the fastener (i.e., when the shaft is rotated clockwise). In the illustrative embodiment, when the shaft 14 is rotated in a counter-clockwise direction, the shaft 14 engages the surfaces 362 of the inner walls 354, and each intersection point 374 of the geometry 376 defines the outermost point of contact between the shaft 14 and the socket 310. As shown in FIG. 15, an imaginary radius line 392 extends between the geometric center 390 and each intersection point 374 of the geometry 376. When the shaft 14 is rotated counter-clockwise, as indicated by arrow 394 in FIG. 15, the radius line 392 defines the moment arm for the torque transmitted to the socket 310.

When the shaft 14 is rotated in a clockwise direction, as indicated by arrow 396 in FIG. 15, the intersection point 366 between the surfaces 362, 364 is the outermost point of contact between the shaft 14 and the socket 310. As shown in FIG. 15, an imaginary radius line 398 extends between the geometric center 390 and each intersection point 366. When the shaft 14 is rotated clockwise, the radius line 398 defines the moment arm for the torque transmitted to the socket 310. In the illustrative embodiment, the radius line 398 is less than the radius line 392. As a result, the amount of torque transmitted to the socket 310 when the shaft 14 is rotated clockwise to tighten a fastener is less than the amount of torque transmitted to the socket 310 when the shaft 14 is rotated counter-clockwise to loosen the fastener.

Localized stresses are created at each of the intersection points 366, 374 when the shaft 14 is rotated clockwise or counter-clockwise, respectively. Because the radius line 398 is shorter than the radius line 392, the localized stresses generated at the intersection point 366 during clockwise rotation are higher than the localized stresses generated at the intersection point 374 during counterclockwise rotation. As a result, the contact between the socket 310 and the shaft 14 of the wrench 12 is more elastic and introduces a spring effect that converts a portion the kinetic energy generated by the wrench 12 into potential energy, thereby diminishing the kinetic energy transferred to the disk 60 when the socket 310 is rotated clockwise. Because this results in less energy being transferred to the fastener when the disk 60 decelerates, this spring effect also reduces the torque provided to the fastener during tightening.

In other embodiments, the socket 310 may also be designed to move between the geometries 376, 386 depending on the direction of rotation of the shaft 14 of the wrench 12. In such embodiments, the intersection points 366 define initial points of contact when the shaft 14 is rotated clockwise, but the recess 338 is sized such that the shaft 14 is advanced into engagement with the surfaces 364 of the inner walls 354. Similar to the embodiments of FIGS. 1-12, this limited movement between the shaft 14 and the socket 310 introduces a spring effect that converts a portion the kinetic energy generated by the wrench 12 into potential energy, thereby diminishing the kinetic energy transferred to the disk 60 when the socket 310 is rotated clockwise. As a result, less energy is transferred to the fastener when the disk 60 decelerates such that less torque is provided to the fastener during tightening.

Figure 16:
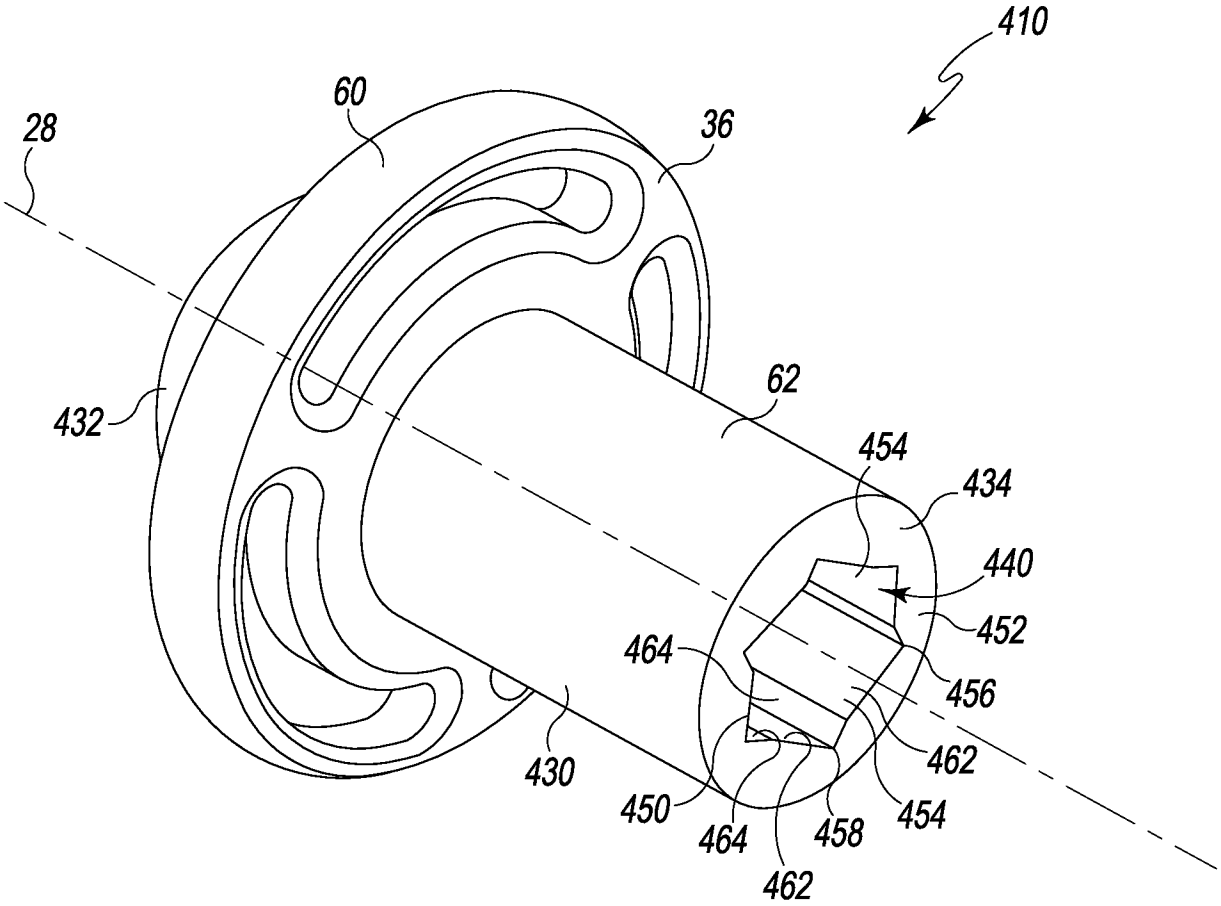
FIG. 16 is a perspective view of another embodiment of a rotary impact device.
Figure 17:
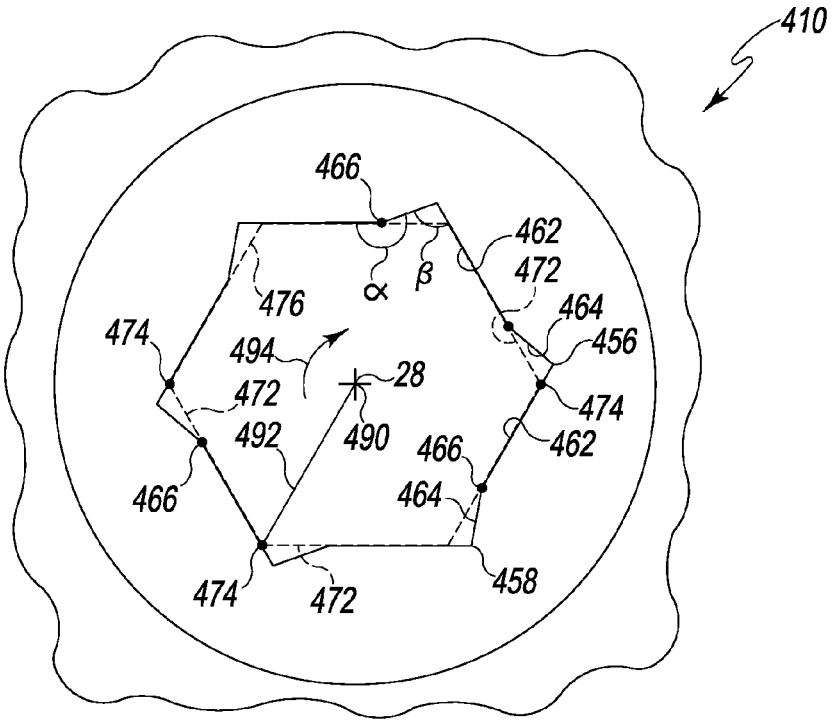
FIG. 17 is an elevation view of the rotary impact device of FIG. 16 showing the output recess.
Figure 18:
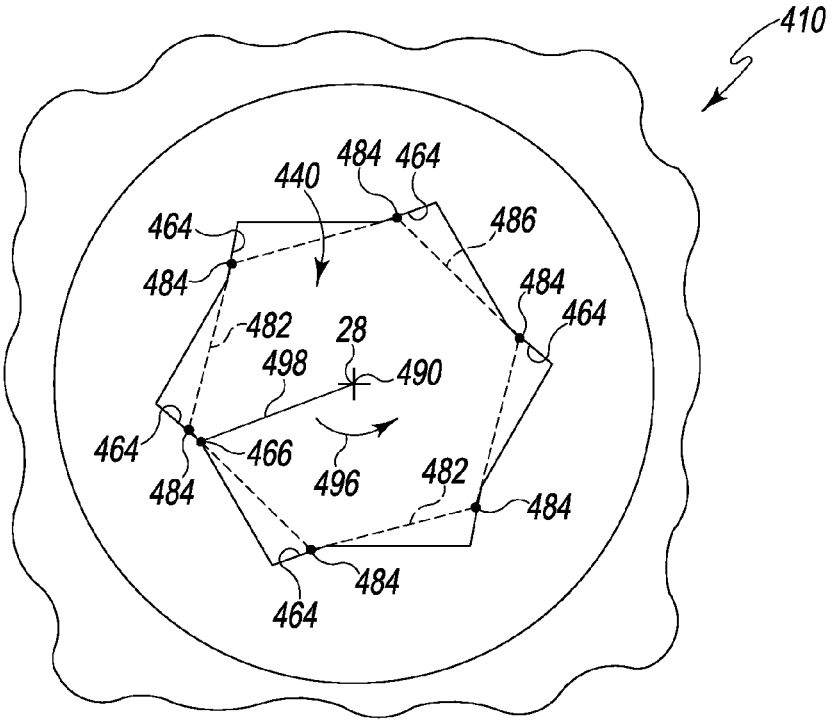
FIG. 18 is an elevation view similar to FIG. 17.

Referring now to FIGS. 16-18, another embodiment of a rotary impact device (hereinafter socket 410) is shown. Many features of the embodiment of FIGS. 16-18 are the same as the features of the embodiment of FIGS. 13-15. The same reference numbers used in FIGS. 13-15 will be used to identify those features that are the same in FIGS. 16-18. In contrast to the socket 310, the outermost point of drive contact between the shaft 14 and the socket 410 does not change based on the direction of rotation of the shaft 14. Instead, as described in greater detail below, the geometries defined by the output recess 440 of the socket 410 shift the outermost point of drive contact between the socket 410 and a fastener based on the direction of rotation. As a result, the amount of torque delivered by the socket 410 to the fastener when loosening the fastener is different from the amount of torque delivered when tightening the fastener.

As shown in FIG. 16, the socket 410 has a longitudinal axis 28 that also defines the rotational axis of the socket 410 when it is secured to the output shaft 14. The socket 410 also includes a body 430 that extends along the axis 28 from a longitudinal end 432 to the opposite longitudinal end 434. The body 430 has a cylindrical outer surface 62 that extends from the end 432 to the end 434, and the socket 410 includes an inertia member 36 that is attached to the body 430 between the ends 432, 434. The inertia member 36 includes a disk 60 that extends outwardly from the outer surface 62 of the body 430, and the disk 60 acts as a stationary flywheel for the socket 410. The socket 410 also includes an input recess (not shown) that is defined at the other longitudinal end 432 of the body 430. The input recess of the socket 410, like the input recess 38 of FIGS. 1-8, is sized to receive the shaft 14 of the wrench 12.

The body 430 and the inertia member 36 are formed as a single monolithic component in the illustrative embodiment. The body 430 and the inertia member 36 are formed from a metallic material such as, for example, steel. It should be appreciated that in other embodiments the inertia member 36 and the body 430 may be formed as separate components that are later assembled together. In such embodiments, the member 36 and the body 430 may be formed from the same or different materials.

As shown in FIGS. 16-18, the socket 410 includes an output recess 440, which is sized to receive a head of a fastener and is defined at the longitudinal end 434 of the body 430. The recess 440 includes opening 450 defined in an end surface 452 of the body 430. A plurality of inner walls 454 extend inwardly from the opening 450 to define the input recess 440. Each inner wall 454 extends from an end 456 to another end 458.

Each inner wall 454 also includes a substantially planar surface 462 that extends from the end 456 toward the end 458. Another substantially planar surface 464 that extends from the end 458 toward the other surface 462, and the surfaces 462, 464 meet at an intersection point 466. As shown in FIG. 17, the surface 464 of each inner wall 454 is angled relative to its corresponding surface 462, and an angle $\alpha$ is defined between the surfaces 462, 464. In the illustrative embodiment, the angle $\alpha$ is an obtuse angle such that each surface 464 extends radially outward from the intersection point 466 to the end 458. Additionally, an angle $\beta$ is defined between the surfaces 462, 464 of adjacent inner walls 454. In the illustrative embodiment, the angle $\beta$ is also an obtuse angle. It should be appreciated that in other embodiments the angles $\alpha$, $\beta$ may be acute angles.

As shown in FIG. 17, the surface 462 of each inner wall 454 defines a distance 470 between the end 456 and the intersection point 466. Each surface 462 defines an imaginary line 472 that intersects the surface 462 of an adjacent inner wall 454 at an intersection point 474. In the illustrative embodiment, the surfaces 462 of adjacent inner walls 454 cooperate to define a geometry 476 of the recess 440 that is hexagonal. As shown in FIG. 14, the intersection points 474 are positioned at each corner of the hexagonal geometry 476. The geometry 476 illustratively matches the configuration of a head of a fastener. It should be appreciated that in other embodiments the surfaces 462 may define a different geometric shape such as, for example, a square or octagonal to match a square or octagonal shaped fastener.

The other surface 464 of each inner wall 454 defines a distance 480 between the end 458 and the intersection point 466. In the illustrative embodiment, the distance 480 defined by the surface 464 is less than the distance 470 defined by the surface 462, and, as shown in FIG. 17, each surface 464 is shorter than each surface 462. As shown in FIG. 18, each surface 464 defines an imaginary line 482 that intersects the surface 464 of an adjacent inner wall 454 at an intersection point 484. In the illustrative embodiment, the surfaces 464 cooperate to define a geometry 486 of the recess 440 that is hexagonal.

As shown in FIGS. 17-18, the geometry 486 is rotated relative to the geometry 476, the geometry 486 matches the geometry 476. In the illustrative embodiment, the geometries 476, 486 share a common geometric center 490, which is also coincident with the longitudinal axis 28 of the socket 410. It should be appreciated that in other embodiments the geometries 476, 486 may be offset from one another. In still other embodiments, the geometries 476, 486 may not match.

As described above, the outermost point of drive contact between the fastener and the socket 410 changes based on the direction of rotation of the socket 410. As a result, the amount of torque delivered by the socket 410 to the fastener when loosening the fastener is different from the amount of torque delivered when tightening the fastener. In the illustrative embodiment, when the socket 410 is to loosen the fastener, the fastener engages the surfaces 462 of the inner walls 454, and each intersection point 474 of the geometry 476 defines the outermost point of contact between the fastener and the socket 410. As shown in FIG. 17, an imaginary radius line 492 extends between the geometric center 490 and each intersection point 474 of the geometry 476. When the socket 410 is rotated to loosen the fastener, as indicated by arrow 494 in FIG. 17, the radius line 492 defines the moment arm for the torque transmitted by the socket 410 to the fastener.

When the socket 410 is rotated to tighten the fastener, as indicated by arrow 496 in FIG. 18, the intersection point 466 is the outermost point of contact between the fastener and the socket 410. As shown in FIG. 18, an imaginary radius line 498 extends between the geometric center 490 and each intersection point 466. When the socket 410 is rotated as indicated by arrow 496, the radius line 498 defines the moment arm for the torque transmitted by the socket 410 to the fastener. In the illustrative embodiment, the radius line 498 is less than the radius line 492. As a result, the amount of torque transmitted by the socket 410 when rotated to tighten a fastener is less than the amount of torque transmitted by the socket 410 when rotated to loosen the fastener.

Localized stresses are created at each of the intersection points 466, 474 when the socket 410 is rotated. Because the radius line 498 is shorter than the radius line 492, the localized stresses generated at the intersection point 466 when tightening the fastener are higher than the localized stresses generated at the intersection point 474 when loosening the fastener. As a result, the contact between the socket 410 and fastener is more elastic and introduces a spring effect that converts a portion the kinetic energy generated by the wrench 12 into potential energy, thereby diminishing the kinetic energy transferred from the socket 410 to the fastener and reducing the torque provided to the fastener during tightening.

In other embodiments, the socket 410 may also be designed to move between the geometries 476, 486 depending on the direction of rotation. In such embodiments, the intersection points 466 define initial points of contact when the socket 410 is rotated to tighten the fastener, but the recess 440 is sized such that the fastener is advanced into engagement with the surfaces 464 of the inner walls 454. Similar to the embodiments of FIGS. 1-12, this limited movement between the fastener and the socket 410 introduces a spring effect that converts a portion the kinetic energy generated by the wrench 12 into potential energy, thereby diminishing the kinetic energy transferred from the socket 310 to the fastener such that less torque is provided to the fastener during tightening.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected. For example, a single socket may include both the input recess of the socket 310 and the output recess of the socket 410. Additionally, a single socket may include the input recess of socket 310 or the output recess of the socket 410 and also be formed as a two-piece socket similar to the sockets of FIGS. 1-12. In other embodiments, the inertia member may also be omitted from any of the socket designs described above.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A socket for an impact tool, the socket comprising:

a body extending between a first longitudinal end and a second longitudinal end, the body including:

an input recess defined in the first longitudinal end, the input recess configured to receive an anvil of the impact tool, an output recess defined in the second longitudinal end, the output recess being configured to receive a head of a fastener, a cylindrical outer surface that defines a first diameter, and a disk positioned between the first longitudinal end and the second longitudinal end of the body, the disk defining a second diameter that is greater than the first diameter, wherein at least one of the input recess or the output recess is defined by a plurality of inner walls extending inwardly from an outer opening and parallel to a longitudinal axis extending through the body, wherein a cross-section of the plurality of inner walls form a plurality of line segments form a polygon, and wherein the plurality of line segments are characterized as:

(i) six primary linearly extending line segments each extending from a first end to an intersection point;

(ii) six secondary linearly extending line segments each extending from the intersection point of one of the six primary linearly extending line segments to the first end of an adjacent one of the six primary linearly extending line segments, where each of the six secondary linearly extending line segments is shorter in length than each of the six primary linearly extending line segments; and wherein an obtuse angle is defined at each of the intersection points adjoining one of the six primary linearly extending line segments to one of the six secondary linearly extending line segments.

2. The socket of claim 1, wherein the disk includes (i) at least two ribs extending outwardly from the cylindrical outer surface, and (ii) a ring secured to an outer radial end of each rib.

3. The socket of claim 1, wherein the disk includes:

a first surface extending outwardly from the cylindrical outer surface, a second surface positioned opposite the first surface and extending outwardly from the cylindrical outer surface, and an annular outer surface connecting the first surface to the second surface.

4. The socket of claim 1, wherein the body is formed as a single monolithic steel body.

* * * * *